US011423812B2

(12) United States Patent
Wu et al.

(10) Patent No.: US 11,423,812 B2
(45) Date of Patent: Aug. 23, 2022

(54) ROTATABLE SUBSTRATES HAVING MICRO-LIGHT EMITTING DIODES (LEDS)

(71) Applicant: Hewlett-Packard Development Company, L.P., Spring, TX (US)

(72) Inventors: Kuan-Ting Wu, Taipei (TW); Wei-Chung Chen, Taipei (TW); Cheng-Hua Yu, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,459

(22) PCT Filed: Dec. 14, 2017

(86) PCT No.: PCT/US2017/066327

§ 371 (c)(1),
(2) Date: Jul. 27, 2019

(87) PCT Pub. No.: WO2019/117907

PCT Pub. Date: Jun. 20, 2019

(65) Prior Publication Data

US 2021/0280099 A1 Sep. 9, 2021

(51) Int. Cl.

| | |
|---|---|
| ***G09F 9/37*** | (2006.01) |
| ***G09F 9/33*** | (2006.01) |
| ***G09G 3/34*** | (2006.01) |

(52) U.S. Cl.

CPC ..... *G09F 9/37* (2013.01); *G09F 9/33* (2013.01); *G09G 3/3413* (2013.01); *G09G 2300/0452* (2013.01)

(58) Field of Classification Search

CPC ..... G09F 9/37

USPC ..... 345/55

See application file for complete search history.

(56) References Cited

U.S. PATENT DOCUMENTS

| | | | | |
|---|---|---|---|---|
| 7,289,090 | B2 | 10/2007 | Morgan | |
| 2002/0005826 | A1* | 1/2002 | Pederson | G09F 9/33 345/82 |
| 2005/0128441 | A1* | 6/2005 | Morgan | G03B 21/2033 353/102 |
| 2015/0022424 | A1 | 1/2015 | Jepsen | |
| 2016/0240593 | A1 | 8/2016 | Gu et al. | |
| 2017/0104040 | A1 | 4/2017 | Huangfu et al. | |
| 2018/0187864 | A1* | 7/2018 | Hu | F21S 4/28 |

FOREIGN PATENT DOCUMENTS

| | | | |
|---|---|---|---|
| CN | 103928498 | A | 7/2014 |
| CN | 107103847 | A | 8/2017 |
| EP | 301870 | A3 | 2/1990 |
| WO | WO-2017132050 | A1 | 8/2017 |

OTHER PUBLICATIONS

Samsung Video Walls Deliver Maximum Impact, http://www.myldi.com/pics/samsung/Samsung_Association_files/Video%20Wall%20Features%20White%20Paper.pdf.

* cited by examiner

*Primary Examiner* — Long D Pham

(74) *Attorney, Agent, or Firm* — Brooks, Cameron & Heubsch PLLC

(57) ABSTRACT

In some examples, a pixel comprises a plurality of subpixels, wherein each subpixel includes a micro-motor, a rotatable substrate in which the micro-motor is embedded, and a plurality of micro-light emitting diodes (LEDs) embedded in the rotatable substrate.

18 Claims, 5 Drawing Sheets

330

ROTATABLE SUBSTRATES HAVING MICRO-LIGHT EMITTING DIODES (LEDS)

BACKGROUND

Displays may use pixels where each pixel may include colors such as red, blue, and/or green (RGB). The pixels having RGB colors may be used to produce various colors. For example, a display having RGB pixels can produce various colors in order to generate and display content on the display.

DETAILED DESCRIPTION

Some displays may utilize pixels included in the display to create an image. As used herein, the term "pixel" can, for example, refer to a controllable element of a picture represented on a display.

In some examples, a higher pixel count may produce a higher quality display. A pixel can include various colors. The colors may include RGB, as described above, or red, green, blue, and yellow (RGBY). RGB and/or RGBY included in a pixel can be used to produce various other colors. For example, a combination of RGB and/or a combination of RGBY may be used to produce a particular color in a pixel. The pixels that comprise a display can produce particular colors in order to create the image.

In some instances, a display can include thousands or millions of pixels, which may be arranged in a grid of rows and columns to create images on the display. The number of pixels that can be displayed on the display can be referred to as the resolution of the image.

As used herein, the term "display" can, for example, refer to an output device which can display information via a screen. A display may include a television, computer monitor, mobile device display, other type of display device, or any combination thereof, which can receive and output a video signal. The display can be a liquid crystal display (LCD), LED display, organic light-emitting diode (OLED) display, polymer light-emitting diode (PLED) display, micro-LED display, electronic paper display (EPD), bistable display, and/or a quantum-dot LED (QLED) display, among other types of displays.

Some displays can include a plurality of pixels, where each pixel can include RGB colors. Some displays may include a high physical density of pixels to create a high-resolution display. However, a high physical density of pixels can increase display complexity, which can result in a high cost increase in product manufacturing.

Rotatable substrates having micro-LEDs, according to the disclosure, can allow for a pixel of a display to include three subpixels. As used herein, the term "subpixel" can, for example, refer to a smallest controllable element of a picture represented on a display. Each of the three subpixels can include RGB micro-LEDs, allowing for a high-resolution display. In some examples, each of the three subpixels can include RGBY micro-LEDs. As used herein, the term "micro-LED" can, for example, refer to a microscopic light emitting diode.

Rotatable substrates having micro-LEDs can improve brightness for power efficiency. In other words, by using rotatable substrates with micro-LEDs, the same display brightness relative to a single RGB pixel can be achieved for lower power. The sub-pixels having micro-LED sizes can also result in a higher resolution display.

Figure 1:
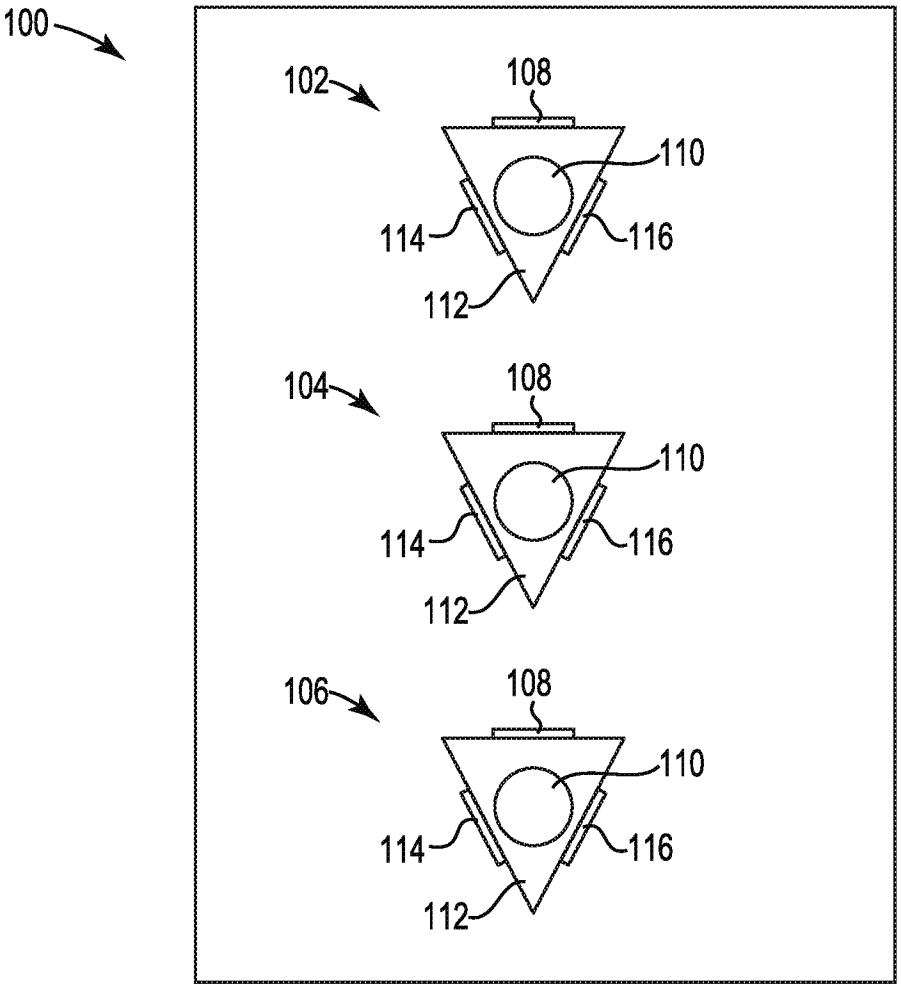
FIG. 1 illustrates an example of a pixel with rotatable substrates having micro-LEDs consistent with the disclosure.

FIG. 1 illustrates an example of a pixel 100 with rotatable substrates 112 having micro-LEDs 108, 114, 116 consistent with the disclosure. As illustrated in FIG. 1, pixel 100 can include subpixels 102, 104, and 106. Each subpixel 102, 104, and 106 can include rotatable substrate 112, micro-motor 110, and micro-LEDs 108, 114, 116.

As illustrated in FIG. 1, pixel 100 can include subpixels 102, 104, and 106. Each subpixel 102, 104, and 106 can include a micro-motor 110, a rotatable substrate 112, and micro-LEDs 108, 114, and 116. As used herein, the term "micro-motor" can, for example, refer to a machine powered by electricity that supplies motive power. For example, micro-motor 110 can supply motive power to rotatable substrate 112, as is further described herein.

For example, micro-motor 110 can be an electromagnetic micro-motor, a piezoelectric micro-motor, among other types of micro-motor. As used herein, the term "rotatable substrate" can, for example, refer to a solid substance or medium to which another substance is applied and to which another substance adheres. Rotatable substrate 112 can be, for example, a thermoplastic material, thermosetting polymer material, a resin material, and/or a glass material, among other types of materials.

Rotatable substrate 112 can include three surfaces, where each surface includes a micro-LED 108, 114, 116. For example, each surface of the three surfaces can include a micro-LED 108, 114, 116 embedded in the surface of rotatable substrate 112. As used herein, the term "embedded" can, for example, refer to being fixed into a surrounding mass. For example, micro-LEDs 108, 114, 116 can be fixed into the surrounding mass comprising rotatable substrate 112.

As illustrated in FIG. 1, subpixel 102 can include three surfaces, where each surface includes a micro-LED 108, 114, 116. For example, each micro-LED can be a different colored micro-LED. For instance, subpixel 102 can include a blue micro-LED 108 on one surface, a green micro-LED 114 on a second surface, and red micro-LED 116 on a third surface. As a result of subpixel 102 including a red micro-LED 116, a green micro-LED 114, and a blue micro-LED 108, subpixel 102 can comprise an RGB subpixel.

Rotatable substrate 112 can include micro-motor 110. For example, micro-motor 110 can be embedded in rotatable substrate 112. Micro-motor 110 can rotate the rotatable substrate 112. For instance, micro-motor 110 may receive an input from, for example, a controller, where the input can cause micro-motor 110 to rotate rotatable substrate 112, as is further described with respect to FIG. 3 and FIG. 5.

As illustrated in FIG. 1, pixel 100 can include subpixel 104. Similar to subpixel 102, subpixel 104 can include three surfaces, where each surface includes a micro-LED 108, 114, 116. For example, each micro-LED can be a different colored micro-LED. For example, subpixel 104 can include a blue micro-LED 108 on one surface, a green micro-LED 114 on a second surface, and red micro-LED 116 on a third surface. As a result of subpixel 104 including a red micro-LED 116, a green micro-LED 114, and a blue micro-LED 108, subpixel 104 can comprise an RGB subpixel.

Similarly, pixel 100 can include subpixel 106. Similar to subpixels 102 and 104, subpixel 106 can include three surfaces, where each surface includes a micro-LED 108, 114, 116. For example, each micro-LED can be a different colored micro-LED. For example, subpixel 106 can include a blue micro-LED 108 on one surface, a green micro-LED 114 on a second surface, and red micro-LED 116 on a third surface. As a result of subpixel 106 including a red micro-LED 116, a green micro-LED 114, and a blue micro-LED 108, subpixel 104 can comprise an RGB subpixel.

In other words, as illustrated in FIG. 1, pixel 100 can include three subpixels 102, 104, 106, where each subpixel can include a rotatable substrate 112, a micro-motor 110, and three micro-LEDs 108, 114, and 116. Each micro-motor 110 can cause each rotatable substrate 112 to rotate, allowing for each subpixel 102, 104, and 106 to emit light from a differently colored micro-LED 108, 114, 116 based on an input from a controller, as is further described herein with respect to FIG. 3 and FIG. 5.

In some examples, rotatable substrate 112 can rotate in a clockwise direction. For example, rotatable substrate 112 can be rotated in a clockwise direction by micro-motor 110. For instance, micro-motor 110 may receive an input from, for example, a controller, to rotate in a clockwise direction. The input can then cause micro-motor 110 to rotate rotatable substrate 112 in a clockwise direction.

In some examples, rotatable substrate 112 can rotate in a counter-clockwise direction. For example, rotatable substrate 112 can be rotated in a counterclockwise direction by micro-motor 110. For instance, micro-motor 110 may receive an input from, for example, a controller, to rotate in a counter-clockwise direction. The input can then cause micro-motor 110 to rotate rotatable substrate 112 in a counter-clockwise direction.

Figure 2:
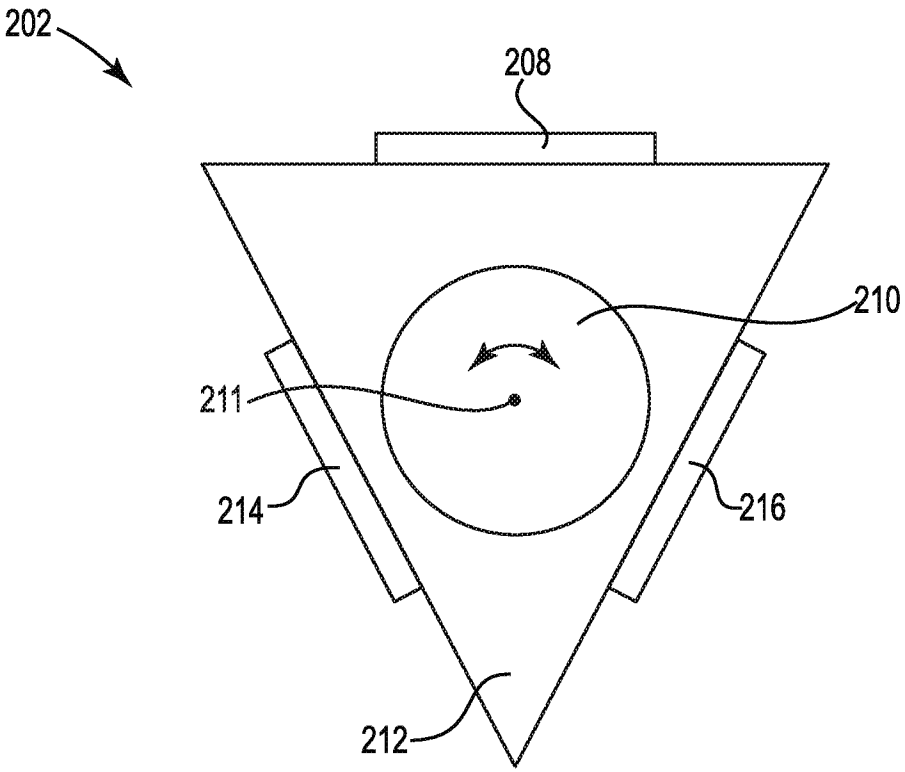
FIG. 2 illustrates an example of a subpixel with a rotatable substrate having micro-LEDs consistent with the disclosure.
Figure 4:
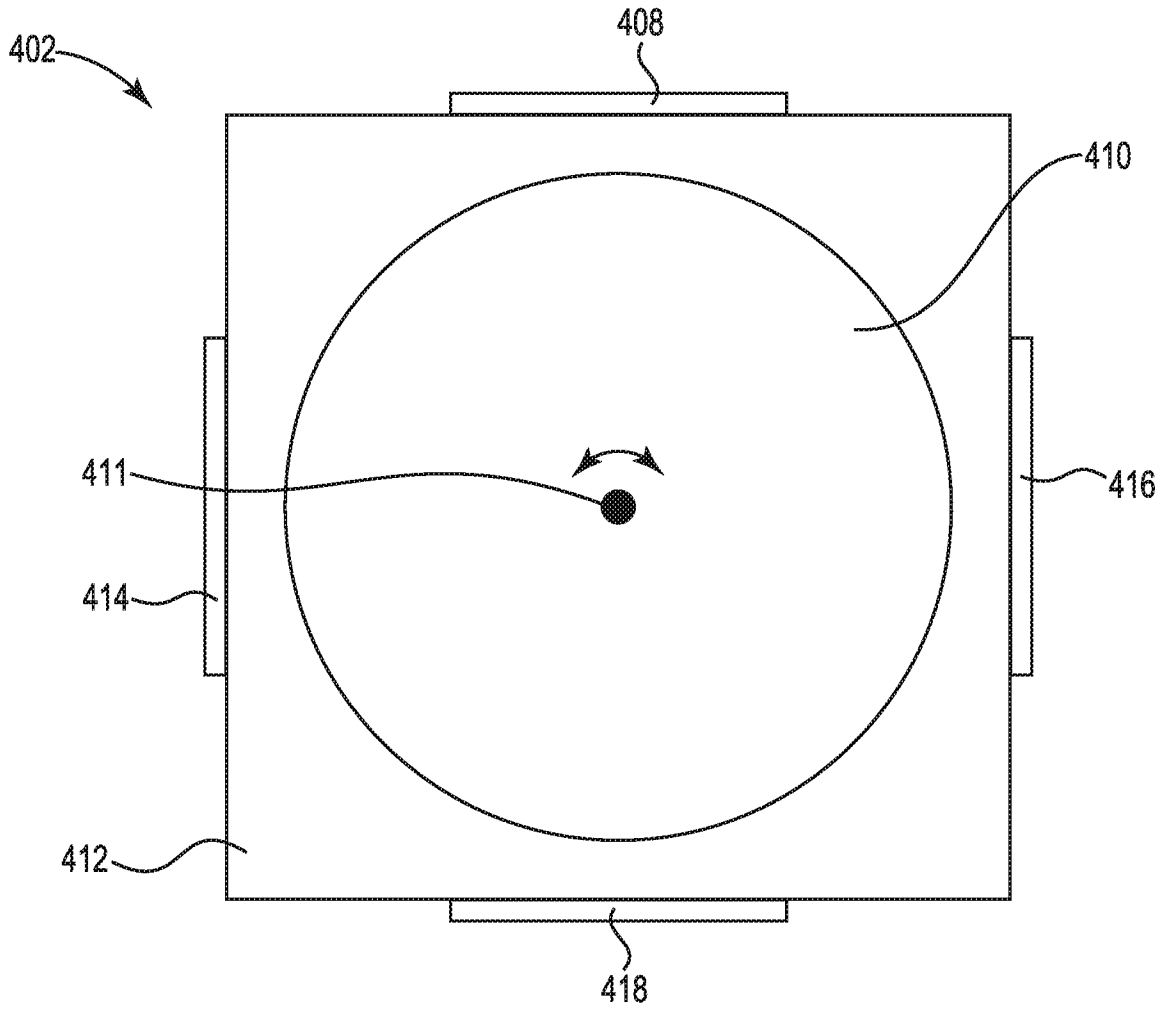
FIG. 4 illustrates an example of a subpixel with a rotatable substrate having micro-LEDs consistent with the disclosure.

Each rotatable substrate 112 of a corresponding subpixel can rotate about a central axis of the rotatable substrate 112, as is further described with respect to FIG. 2 and FIG. 4.

In some examples, a subpixel can include four surfaces, where each surface includes a micro-LED. For example, each micro-LED can be a different colored micro-LED. For example, a subpixel can include a blue micro-LED on one surface, a green micro-LED on a second surface, red micro-LED on a third surface, and a yellow micro-LED on a fourth surface, comprising an RGBY subpixel, as is further described with respect to FIG. 4.

FIG. 2 illustrates an example of a subpixel with a rotatable substrate 212 having micro-LEDs 208, 216 and 214 consistent with the disclosure. As illustrated in FIG. 2, subpixel 202 (e.g., subpixel 102, previously described in connection with FIG. 1) can include rotatable substrate 212 (e.g., rotatable substrate 112, previously described in connection with FIG. 1), micro-motor 210 (e.g., micro-motor 110, previously described in connection with FIG. 1), micro-LEDs 208, 214 and 216 (e.g., micro-LEDs 108, 114, and 116, previously described in connection with FIG. 1), and central axis 211.

Rotatable substrate 212 can include three surfaces, where each surface includes a micro-LED. For example, each surface of the three surfaces can include one micro-LED 208, micro-LED 214, and a micro-LED 216 embedded in the surface of rotatable substrate 212.

As illustrated in FIG. 2, subpixel 202 can have three surfaces where each surface includes a micro-LED 208, 214, 216. As previously described in connection with FIG. 1, each micro-LED can be a different colored micro-LED. For example, subpixel 202 can include a blue micro-LED 208 on one surface, a green micro-LED 214 on a second surface, and red micro-LED 216 on a third surface, resulting in an RGB subpixel. As a result of subpixel 202 including a red micro-LED 216, a green micro-LED 214, and a blue micro-LED 208, subpixel 202 can comprise an RGB subpixel.

As previously described in connection with FIG. 1, rotatable substrate 212 can include micro-motor 210. For example, micro-motor 210 can be embedded in rotatable substrate 212. Micro-motor 210 can rotate the rotatable substrate 212. For instance, micro-motor 210 may receive an input from, for example, a controller, where the input can cause micro-motor 210 to rotate rotatable substrate 212, as is further described with respect to FIG. 3 and FIG. 5.

Micro-motor 210 can rotate the rotatable substrate 212 about a central axis 211 in a clockwise direction and/or a counter-clockwise direction, as is further described herein. As used herein, the term "axis" can, for example, refer to a line about which a rotating body turns. For example, central axis 211 can be a line about which rotatable substrate 212 turns, as is further described herein.

In some examples, rotatable substrate 212 can be rotated in a clockwise direction by micro-motor 210. For instance, micro-motor 210 may receive an input from, for example, a controller, to rotate in a clockwise direction. The input can then cause micro-motor 210 to rotate rotatable substrate 212 in a clockwise direction.

Rotation of rotatable substrate 212 by micro-motor 210 in a clock wise direction can cause micro-LEDs embedded in rotatable substrate 212 to be correspondingly rotated clockwise. For instance, as rotatable substrate 212 is rotated by micro-motor 210, blue micro-LED 208, embedded in rotatable substrate 212, as illustrated in FIG. 2, may be rotated clockwise to the position of red micro-LED 216. Accordingly, red micro-LED 216 may rotate clockwise and to the position of green micro-LED 214.

In some examples, micro-motor 210 can rotate the rotatable substrate 212 about a central axis 211 in a counter-clockwise direction. For example, rotatable substrate 212 can be rotated in a counter-clockwise direction by micro-motor 210. For instance, micro-motor 210 may receive an input from, for example, a controller, to rotate in a counter-clockwise direction. The input can then cause micro-motor 210 to rotate rotatable substrate 212 in a counter-clockwise direction.

Rotation of rotatable substrate 212 by micro-motor 210 in a counter-clockwise direction can cause micro-LEDs embedded in rotatable substrate 212 to be correspondingly rotated counter-clockwise. For instance, as rotatable substrate 212 is rotated by micro-motor 210 in a counter-clockwise direction, blue micro-LED 208, embedded in rotatable substrate 212, as illustrated in FIG. 2, may be rotated counter-clockwise to the position of green micro-LED 214. Accordingly, green micro-LED 214 may rotate counter-clockwise to the position of red micro-LED 216.

Figure 3:
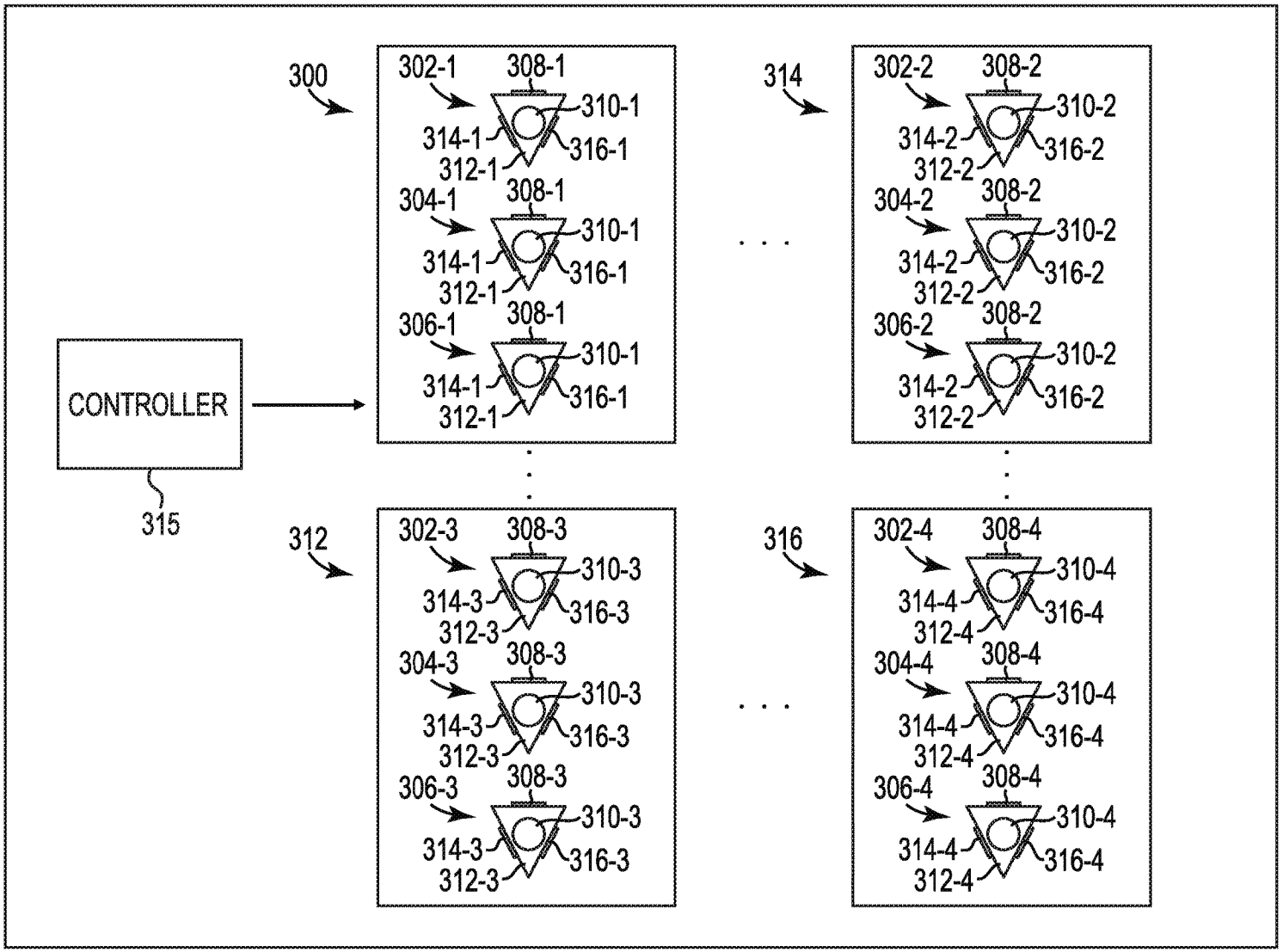
FIG. 3 illustrates an example of a display with pixels having subpixels consistent with the disclosure.

FIG. 3 illustrates an example of a display 300 with pixels having subpixels 302, 304, 306, consistent with the disclosure. As illustrated in FIG. 3, display 330 can include a controller 315, pixels 300, 312, 314, and 316. Each pixel can include three subpixels 302-1, 304-1, 306-1, 302-2, 304-2, 306-2, 302-3, 304-3, 306-3, 302-4, 304-4, 306-4 (referred to collectively as subpixels 302, 304, 306). For instance, pixel 300, as illustrated in FIG. 3, can include subpixel 302-1, 304-1, 306-1.

As illustrated in FIG. 3, each subpixel 302, 304, 306 can respectively include a micro-motor 310-1, 310-2, 310-3

(referred to collectively as micro-motor 310), a rotatable substrate 312-1, 312-2, 312-3 (referred to collectively as rotatable substrate 312), and micro-LEDs 308-1, 314-1, 316-1, 308-2, 314-2, 316-2, 308-3, 314-3, 316-3, 308-4, 314-4, 316-4 (referred to collectively as micro-LEDs 308, 314, 316) embedded in the rotatable substrate 312.

As used herein, the term controller can, for example, refer to video display controller. In some examples, a controller can be integrated circuit included in a video signal generator, a device responsible for the production of a television video signal in a computing or game system, and/or a main component of a video signal generator logic, responsible to generate a timing of video signals, among other examples of a controller.

As illustrated in FIG. 3, rotatable substrate 312-1 of subpixel 302-1 can include three surfaces, where each surface includes a micro-LED 308-1, a micro-LED 314-1, and a micro-LED 316-1. Each surface of the three surfaces can include a micro-LED 308-1, 314-1, 316-1 embedded in the surface of rotatable substrate 312-1.

As illustrated in FIG. 3, subpixels 302, 304, 306 can include three surfaces, where each surface includes a micro-LED 308, 314, 316. Each micro-LED 308, 314, 316 can be a different colored micro-LED. For example, subpixel 302-1 can include a blue micro-LED 308-1 on one surface, a green micro-LED 314-1 on a second surface, and red micro-LED 316-1 on a third surface. As a result, of subpixel 302-1 can comprise an RGB subpixel.

Rotatable substrate 312 can include micro-motor 310. For example, micro-motor 310-1 can be embedded in rotatable substrate 312-1. Micro-motor 310 can rotate the rotatable substrate 312. For instance, micro-motor 310-1 may receive an input from, for example, a controller 315, wherein the input can cause micro-motor 310-1 to rotate rotatable substrate 312-1, causing subpixel 302-1 to rotate.

As previously described in connection with FIG. 2 and similar to subpixel 302-1, subpixel 304-1, can include three surfaces, where each surface includes a micro-LED 308-1, 314-1, 316-1. Subpixel 304-1 can include a blue micro-LED 308-1 on one surface, a green micro-LED 314-1 on a second surface, and a red micro-LED 316-1 on a third surface, comprising an RGB subpixel.

Rotatable substrate 312-1 of subpixel 304-1 can include an embedded micro-motor 310-1. Similar to micro-motor 310-1 of subpixel 302-1, micro-motor 310-1 can rotate the rotatable substrate 312-1 of subpixel 304-1.

As illustrated in FIG. 3, subpixel 306-1, similar to subpixel 302-1 and 304-1, can include three surfaces, where each surface includes a different colored micro-LED. For example, subpixel 306-1 can include a blue micro-LED 308-1 on one surface, a green micro-LED 314-1 on a second surface, and a red micro-LED 316-1 on a third surface, resulting in subpixel 306-1 comprising an RGB subpixel.

Rotatable substrate 312-1 of subpixel 306-1 can include an embedded micro-motor 310-1. Similar to micro-motor 310-1 of subpixel 302-1 and micro-motor 310-1 of subpixel 304-1, micro-motor 310-1 can rotate the rotatable substrate 312-1 of subpixel 306-1.

Similarly, pixel, 312, 314 and 316 of display 330, as illustrated in FIG. 3, can include three subpixels 302, 304, 306. Each subpixel 302, 304, 306 can include a micro-motor 310, a rotatable substrate 312, and micro-LEDs 308, 314, and 316 comprising an RGB subpixel.

Although display 330 is illustrated in FIG. 3 as including four pixels 300, 312, 314 and 316 examples of the disclosure are not so limited. For example, display 330 can include a plurality of pixels, each including subpixels. Each subpixel include can include a micro-motor, a rotatable substrate and micro-LEDs corresponding to RGB and/or RGBY.

Although subpixels 302-1, 304-1, 306-1 are illustrated in FIG. 3 as including three surfaces, examples of the disclosure are not so limited. For example, subpixels 302-1, 304-1, 306-1 can each include four surfaces. In such examples, each subpixel may include a red micro-LED, a green micro-LED, a blue micro-LED, and a yellow micro-LED embedded in each surface, comprising an RGBY subpixel, as is further described in connection with FIG. 4.

Continuing with the RGBY subpixel example, each subpixel of pixels 300, 312, 314 316 can each include four surfaces. Each subpixel may have a red micro-LED, a green micro-LED, a blue micro-LED, and a yellow micro-LED embedded in each surface, resulting in an RGBY subpixel.

Controller 315 can cause each subpixel 302, 304, 306 of pixels 300, 312, 314, and 316 to be rotated. For example, controller 315 can send a signal to micro-motor 310 to cause a particular subpixel 302, 304, 306 to be rotated.

As previously described in connection with FIG. 2, micro-motor 310 can rotate the rotatable substrate 312 about a central axis in a clockwise direction and/or a counter-clockwise direction. For example, rotatable substrate 312-1 can be rotated in a clockwise direction by micro-motor 310-1 and/or a counter-clockwise direction by micro-motor 310-1.

Rotatable substrate 312 of a particular subpixel 302, 304, 306 can rotate by a predetermined angle based on the input from the controller 315 to cause a particular micro-LED 308, 314, 316 of the rotatable substrate 312 to generate the specified color.

In some examples, rotatable substrate 312-1 of subpixel 302-1 of pixel 300 can rotate by a predetermined angle of 90 degrees about a central axis, based on the input from controller 315. This can cause a particular micro-LED 308-1 of the rotatable substrate 312-1 to generate blue color, micro-LED 316-1 to generate a red color, and/or micro-LED 314 to generate green color in response to the input from controller 315.

In some examples, rotatable substrate 312-1 of subpixel 302-1 of pixel 300 can rotate by a predetermined angle of 180 degrees about a central axis, based on the input from controller 315. This can cause a particular micro-LED 308-1 of the rotatable substrate 312-1 to generate blue color, micro-LED 316-1 to generate a red color, and/or micro-LED 314-1 to generate green color.

FIG. 4 illustrates an example of a subpixel 402 with a rotatable substrate 412 having micro-LEDs 408, 416, 414, and 418 consistent with the disclosure. As illustrated in FIG. 4, subpixel 402 can include rotatable substrate 412, micro-motor 410, and micro-LEDs 408, 414, 416, and 418.

Rotatable substrate 412 can include four surfaces, where each surface includes a micro-LED 408, 414, 416 and 418. For example, each surface of the four surfaces can include a micro-LED 408, 414, 416, 418 embedded in the surface of rotatable substrate 412.

As illustrated in FIG. 4, subpixel 402 can have four surfaces where each surface includes a micro-LED 408, 414, 416, and 418. Each micro-LED 408, 414, 416, 418 can be a different colored micro-LED. For example, subpixel 402 can include a blue micro-LED 408 on a first surface, a green micro-LED 414 on a second surface, a red micro-LED 416 on a third surface, and a yellow micro-LED 418 on a fourth surface, resulting in an RGBY subpixel.

Rotatable substrate 412 can include micro-motor 410. For example, micro-motor 410 can be embedded in rotatable substrate 412. Micro-motor 410 can rotate the rotatable substrate 412. For instance, micro-motor 410 may receive an input from, for example, a controller (e.g., controller 315, previously described in connection with FIG. 3), where the input can cause micro-motor 410 to rotate rotatable substrate 412.

Micro-motor 410 can rotate the rotatable substrate 412 about a central axis 411 in a clockwise direction and/or a counter-clockwise direction. For example, rotatable substrate 412 can be rotated in a clockwise and/or counter-clockwise direction by micro-motor 410.

For instance, micro-motor 410 may receive an input from, for example, a controller, to rotate in a clockwise and/or counter-clockwise direction. The input can then cause micro-motor 410 to rotate rotatable substrate 412 in a clockwise direction and/or a counter-clockwise direction.

Rotation of substrate 412 by micro-motor 410 in a clockwise direction can cause micro-LEDs embedded in substrate 412 to be correspondingly rotated clockwise. For instance, as substrate 412 is rotated by micro-motor 410, blue micro-LED 408, embedded in substrate 412, as illustrated in FIG. 4, may rotate clockwise to the position of red micro-LED 416. Accordingly, red micro-LED 416 may rotate clockwise and to the position of yellow micro-LED 418, and yellow micro-LED 418 may take the position of green micro-LED 414.

In some examples, micro-motor 410 can rotate the rotatable substrate 412 about a central axis 411 in a counter-clockwise direction. For example, rotatable substrate 412 can be rotated in a counter-clockwise direction by micro-motor 410. For instance, micro-motor 410 may receive an input from, for example, a controller, to rotate in a counter-clockwise direction. The input can then cause micro-motor 410 to rotate rotatable substrate 412 in a counter-clockwise direction.

Rotation of substrate 412 by micro-motor 410 in a counter-clockwise direction can cause micro-LEDs embedded in substrate 412 to be correspondingly rotated counter-clockwise. For instance, as substrate 412 is rotated by micro-motor 410, blue micro-LED 408, embedded in substrate 412, as illustrated in FIG. 4, may rotate counter-clockwise to the position of green micro-LED 414. Accordingly, green micro-LED 414 may rotate counter-clockwise to the position of yellow micro-LED yellow 418, and yellow micro-LED 418 may rotate to take the position of red micro-LED 416.

Figure 5:
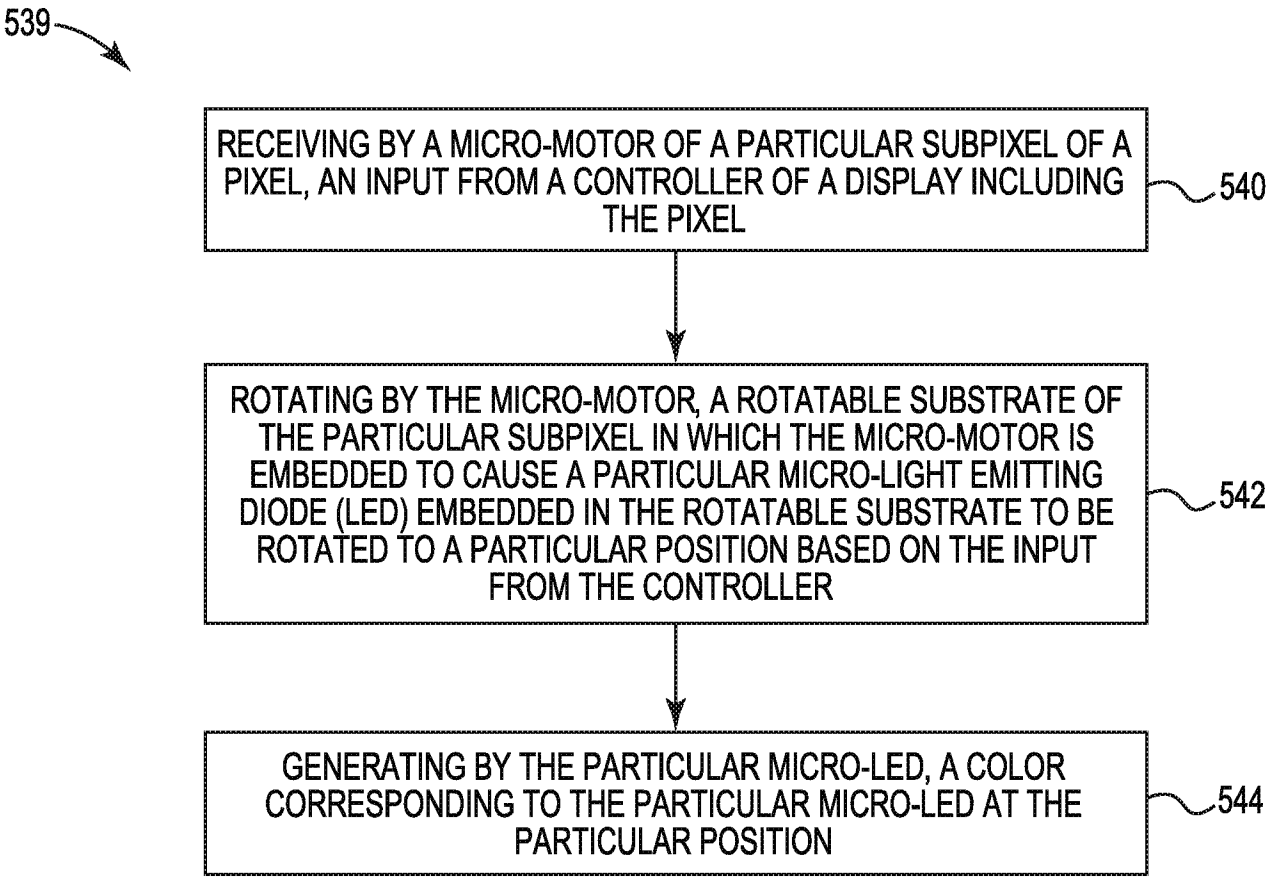
FIG. 5 illustrates an example of a method consistent with the disclosure.

FIG. 5 illustrates an example of a method 539 consistent with the disclosure. Method 539 may be performed by a controller (e.g., controller 315, previously described in connection with FIG. 3) and subpixels (e.g., subpixels 102, 104, 106, 202, 302, 304, 306, and 402, previously described in connection with FIG. 1-FIG. 4, respectively).

At 540, the method 539 may include receiving, by a micro-motor of a particular subpixel of a pixel, an input from a controller of a display including the pixel.

At 542, the method 539 may include rotating by the micro-motor, a rotatable substrate of the particular subpixel in which the micro-motor is embedded to cause a particular micro-LED embedded in the rotatable substrate to be rotated to a particular position based on the input from the controller. For instance, a controller of a display can send an input to a micro-motor, embedded in the rotatable substrate of a subpixel. The received input can cause the micro-motor to rotate rotatable substrate in a clockwise and/or counter-clockwise direction.

Rotation of substrate by micro-motor in a clockwise and/or counter-clockwise direction can cause micro-LEDs embedded in the rotatable substrate to rotate in a clockwise and/or counter-clockwise direction. For instance, rotatable substrate with three surfaces can be rotated by a micro-motor in a counter-clockwise direction. Rotatable substrate can rotate micro-LEDs embedded in the surface.

Rotation of rotatable substrate can cause a blue micro-LED embedded in the rotatable substrate to rotate in a clockwise and/or counter-clockwise direction to a different position. Additionally, a green micro-LED and a red micro-LED, comprising an RGB subpixel, can correspondingly rotate.

In some examples, a rotatable substrate having four surfaces can be rotated by a micro-motor in a clockwise and/or counter-clockwise direction. Rotation of rotatable substrate can cause a blue micro-LED embedded in the rotatable substrate to rotate in a clockwise and/or counter-clockwise direction to a different position. Additionally, a green micro-LED, a red micro-LED, and a yellow micro-LED, comprising an RGBY subpixel, can correspondingly rotate.

Rotation of the rotatable substrate of each subpixel can be about a central axis of each subpixel.

At 544, the method 539 may include generating by the particular micro-LED, a color corresponding to the particular micro-LED at the particular position. For example, in an RGB subpixel, a blue micro-LED can generate a blue color at a particular position, a red micro-LED can generate a red color at the particular position, and a green micro-LED can generate a red color at the particular position. In an RGBY subpixel, a blue micro-LED can generate a blue color at a particular position, a red micro-LED can generate a red color at the particular position, a green micro-LED can generate a red color at the particular position, and a yellow micro-LED can generate a yellow color at the particular position.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The FIGs herein follow a numbering convention in which the first digit corresponds to the drawing figure number and the remaining digits identify an element or component in the drawing. Similar elements or components between different FIGs may be identified by the use of similar digits. For example, 102 may reference element "02" in FIG. 1, and a similar element may be referenced as 202 in FIG. 2. Elements shown in the various FIGs herein can be added, exchanged, and/or eliminated so as to provide a plurality of additional examples of the disclosure. In addition, the proportion and the relative scale of the elements provided in the FIGs are intended to illustrate the examples of the disclosure, and should not be taken in a limiting sense. Further, as used herein, "a plurality of" an element and/or feature can refer to more than one of such elements and/or features.

The invention claimed is:

1. A display, comprising:

a subpixel of a plurality of subpixels, wherein the subpixel includes:

a rotatable substrate, wherein the rotatable substrate includes a plurality of surfaces;

a micro-motor embedded in the rotatable substrate; and a plurality of differently colored micro-light emitting diodes (LEDs), wherein a single micro-LED of the plurality micro-LEDs is embedded in each surface of the plurality of surfaces of the rotatable substrate;

wherein the display is to receive a video signal and output the video signal via the plurality of subpixels.

2. The display of claim 1, wherein the micro-motor rotates the rotatable substrate.

3. The display of claim 1, wherein each subpixel includes three micro-LEDs, and wherein the plurality of surfaces of each subpixel includes three surfaces such that each surface of the rotatable substrate includes an embedded micro-LED.

4. The display of claim 3, wherein the three micro-LEDs include a red micro-LED, a green micro-LED, and a blue micro-LED.

5. The display of claim 1, wherein each subpixel includes four micro-LEDs, and wherein the plurality of surfaces of each subpixel includes four surfaces such that each surface of the rotatable substrate includes an embedded micro-LED.

6. The display of claim 5, wherein the four micro-LEDs include a red micro-LED, a green micro-LED, a blue micro-LED, and a yellow micro-LED.

7. The display of claim 1, wherein the rotatable substrate rotates in a clockwise direction.

8. The display of claim 1, wherein the rotatable substrate rotates in a counter-clockwise direction.

9. The display of claim 1, wherein the subpixel is to emit light from a different micro-LED of the plurality of micro-LEDs when the rotatable substrate is rotated.

10. The display of claim 1, wherein the plurality of micro-LEDs of the subpixel include a first micro-LED and a second micro-LED.

11. The display of claim 10, wherein:

the subpixel is to emit light from the first micro-LED when the rotatable substrate is rotated a first amount; and the subpixel is to emit light from the second micro-LED when the rotatable substrate is rotated a second amount.

12. A display, comprising:

pixels having a plurality of subpixels, wherein each subpixel includes:

a rotatable substrate, wherein the rotatable substrate includes a plurality of surfaces;

a micro-motor embedded in the rotatable substrate; and a plurality of differently colored micro-light emitting diodes (LEDs), wherein a single micro-LED of the plurality of micro-LEDs is embedded in each surface of the plurality of surfaces of the rotatable substrate; and a controller to cause the micro-motor to rotate the plurality of subpixels to cause the micro-LEDs to generate a specified color in each subpixel in response to an input from the controller;

wherein the display is to receive a video signal and output the video signal via the plurality of subpixels.

13. The display of claim 12, wherein each rotatable substrate of a corresponding subpixel rotates about a central axis of the rotatable substrate.

14. The display of claim 12, wherein the rotatable substrate of a particular subpixel of the plurality of subpixels rotates by a predetermined angle based on the input from the controller to cause a particular micro-LED of the rotatable substrate to generate the specified color.

15. The display of claim 12, wherein the plurality of subpixels are arranged in at least one of:

a stripe pattern;

a mosaic pattern; and a delta pattern.

16. A method comprising:

receiving, by a micro-motor embedded in a rotatable substrate of a particular subpixel of a plurality of subpixels, an input from a controller of a display;

rotating, by the micro-motor, the rotatable substrate of the particular subpixel to cause a particular micro-light emitting diode (LED) of a plurality of differently colored micro-LEDs embedded in the rotatable substrate to be rotated to a particular position based on the input from the controller, wherein a single micro-LED of the plurality of micro-LEDs is embedded in each surface of a plurality of surfaces of the rotatable substrate;

generating, by the particular micro-LED, a color corresponding to the particular micro-LED at the particular position; and outputting, by the display comprising the plurality of subpixels, a video signal via the plurality of subpixels.

17. The method of claim 16, wherein the method includes:

rotating, by the micro-motor, different rotatable substrates of other subpixels of the plurality of subpixels to cause other micro-LEDs embedded in the respective different rotatable substrates to be rotated to particular positions based on the input from the controller; and generating, by the other micro-LEDs, colors corresponding to the other micro-LEDs at the respective particular positions.

18. The method of claim 17, wherein the method includes generating, by the combination of colors of the particular micro-LED and the other micro-LEDs, a color by the plurality of subpixels.

* * * * *